US007503318B2

(12) United States Patent
Takahashi et al.

(10) Patent No.: US 7,503,318 B2
(45) Date of Patent: Mar. 17, 2009

(54) FOUR-STROKE ENGINE FOR AN OUTBOARD MOTOR

(75) Inventors: Masanori Takahashi, Shizuoka-ken (JP); Kentaro Kameoka, Shizuoka-ken (JP); Satoshi Miyazaki, Shizuoka-ken (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/616,796

(22) Filed: Dec. 27, 2006

(65) Prior Publication Data

US 2007/0240692 A1 Oct. 18, 2007

(30) Foreign Application Priority Data

Apr. 14, 2006 (JP) ..... 2006-111967

(51) Int. Cl.
*B63H 20/00* (2006.01)

(52) U.S. Cl. ..... 123/572

(58) Field of Classification Search ..... 123/572–574, 123/41.86, 195 HC, 196 W
See application file for complete search history.

(56) References Cited

U.S. PATENT DOCUMENTS

| | | | | |
|---|---|---|---|---|
| 4,493,295 | A * | 1/1985 | Ampferer | 123/41.86 |
| 5,069,192 | A * | 12/1991 | Matsumoto et al. | 123/572 |
| 2004/0244783 | A1 * | 12/2004 | Ookawa et al. | 123/572 |
| 2005/0005921 | A1 * | 1/2005 | Ikeda et al. | 123/572 |

FOREIGN PATENT DOCUMENTS

| | | |
|---|---|---|
| JP | A- 11-301592 | 11/1999 |

* cited by examiner

*Primary Examiner*—M. McMahon
(74) *Attorney, Agent, or Firm*—Knobbe Martens Olson & Bear LLP

(57) ABSTRACT

An engine for an outboard motor is provided that can include a crankcase having a crankcase chamber, a cam chamber, and an oil pan disposed below the crankcase. The engine can also include a crank chamber oil-return passage through which lubricating oil can be returned from the crank chamber to the oil pan. Further, the engine can include a cam chamber oil-return passage through which lubricating oil can be returned from the cam chamber to the oil pan. Finally, the engine can also include a gas passage to provide communication between the crank chamber, the cam chamber, and the oil pan in order to allow passage of blow-by gas without substantial interference with the movement of the lubricating oil.

23 Claims, 6 Drawing Sheets

FOUR-STROKE ENGINE FOR AN OUTBOARD MOTOR

CROSS-REFERENCE TO RELATED APPLICATIONS

The present application is based on and claims priority under 35 U.S.C. § 119 to Japanese Patent Application No. 2006-111967, filed on Apr. 14, 2006, the entire contents of which is expressly incorporated by reference herein.

BACKGROUND

1. Field of the Invention

The present invention generally relates to an engine for an outboard motor, and more specifically, to a four-stroke engine that can include an oil return passage that communicates with an oil pan and a blow-by gas passage that can allow fluid communication between a crank chamber, a cam chamber and an interior of the oil pan.

2. Description of the Related Art

A conventional four-stroke engine for an outboard motor is described in an exemplary system shown in Japanese Patent Document No. JP-A-Hei 11-301592 (hereinafter "JP '592"). According to the system in JP '592, the engine is provided with a crankcase, a crankshaft supported by the crankcase so as to be rotatable around its axis, which extends generally in the vertical direction, a cylinder projecting from the crankcase, and an oil pan disposed below the crankcase.

In the system shown in JP '592, a lubrication device also is provided to lubricate the engine components with lubricating oil. In particular, the system includes a crank chamber oil-return passage, a cam chamber oil-return passage, and a gas passage. The crank chamber oil-return passage allows for the return of lubricating oil to the oil pan from an inner bottom of a crank chamber defined in the crankcase. The cam chamber oil-return passage allows for the return of the lubricating oil to the oil pan from the inner bottom of a cam chamber in the projecting end of the cylinder. Finally, the gas passage places the oil pan and the cam chamber in communication with each other.

When the engine is in operation, an oil pump is used to supply lubricating oil from the oil pan to portions of the engine that need to be lubricated. During lubrication, the lubricating oil tends to collect in the crank chamber and the cam chamber. The oil is recirculated to the interior of the oil pan through the crank chamber oil-return passage and the cam chamber oil-return passage so that it can be supplied again to the portions of the engine to be lubricated.

In addition, blow-by gas leaking from a combustion chamber into the crank chamber flows into the oil pan through the crank chamber oil-return passage, together with the lubricating oil. Then, the blow-by gas having been returned into the oil pan flows into the cam chamber through the gas passage and it is burned after being taken into the intake system. Here, as described above, lubricating oil tending to stay in the cam chamber is returned to the interior of the oil pan through the cam chamber oil-return passage. On the other hand, blow-by gas in the oil pan is forced to flow into the cam chamber through the gas passage formed in addition to the cam chamber oil-return passage.

The system of JP '592 tends to prevent interference between lubricating oil and blow-by gas. In particular, lubricating oil that has returned from the cam chamber to the oil pan does not interfere with blow-by gas that is forced toward the cam chamber from the oil pan. By eliminating any interference with the blow-by gas, the lubricating oil in the cam chamber is returned smoothly to the interior of the oil pan thereby preventing the accumulation of a large quantity of lubricating oil in the cam chamber.

SUMMARY OF THE INVENTION

An aspect of at least one of the embodiments disclosed herein includes the realization that it is possible that the pressure of blow-by gas in the oil pan become higher than that in the crank chamber, depending on the operating conditions of the engine. In such a case, blow-by gas in the oil pan can begin to flow back to the crank chamber through the crank chamber oil-return passage. Thus, the backwardly flowing blow-by gas can interfere with lubricating oil which begins to flow into the oil pan from the crank chamber through the crank chamber oil-return passage. That is, the blow-by gas hinders lubricating oil from flowing into the oil pan from the crank chamber. As a result, a large quantity of lubricating oil is likely to stay in the crank chamber. This large quantity of lubricating oil can then rotate in association with the rotation of the crankshaft in the crank chamber and may cause useless reduction in engine output.

Thus, in accordance with an embodiment, an engine is provided that can allow for a relatively smooth flow of lubricating oil from a crank chamber into an oil pan in order to reduce the likelihood of the rotation of unnecessary amounts of lubricating oil with the crankshaft so that the engine output generally is not affected. Another embodiment can allow for the foregoing with a relative simple structure.

According to an embodiment, a four-stroke engine for an outboard motor is provided that comprises a crankcase, a crank chamber, a crankshaft, a cam chamber, and an oil pan. The crankcase can be configured to support the crankshaft with the axis thereof extending in a generally vertical direction. The oil pan can be disposed below the crankcase. Further, the engine can be formed to include a crank chamber oil-return passage through which lubricating oil can be returned from the inner bottom of the crank chamber to the interior of the oil pan. The engine can also be formed to include a cam chamber oil-return passage through which lubricating oil can be returned from the inner bottom of the cam chamber to the oil pan. In addition to the crank chamber oil-return passage and the cam chamber oil-return passage, a gas passage can also be formed in the engine in order to allow communication between the crank chamber, cam chamber, and the interior of the oil pan.

One aspect of the present invention involves an engine for an outboard motor. The engine comprises a crank chamber, a cam chamber, an oil pan disposed below the crank chamber and a crank chamber oil-return passage that is in fluid communication with the crank chamber and the oil pan. The crank chamber oil-return passage is sized and configured to allow lubricating oil to be returned from the crank chamber to the oil pan. A cam chamber oil-return passage is in fluid communication with the cam chamber and the oil pan. The cam chamber oil-return passage is sized and configured to allow lubricating oil to be returned from the cam chamber to the oil pan. A gas passage is in fluid communication with the crank chamber, the cam chamber, and the oil pan. The gas passage is sized and configured to allow passage of blow-by gas therethrough without interfering with the movement of the lubricating oil.

Another aspect of the present invention involves an engine for an outboard motor. The engine comprises a crankcase that is sized and configured to support a crankshaft. The crankshaft has an axis extending substantially in the vertical direction. The crankcase defines a crank chamber. An oil pan is disposed generally below the crankcase. A crank chamber oil-return passage is in fluid communication with the crank chamber and the oil pan. The crank chamber oil-return passage is sized and configured to allow lubricating oil to be returned from the crank chamber to the oil pan. A gas passage is in fluid communication with the oil pan and the crank chamber. The gas passage is sized and configured to allow passage of blow-by gas therethrough to reduce interference of blow-by gas with lubricating oil from the crankcase to facilitate return of lubricating oil from the crankcase to the oil pan.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

FIGS. 1-6 illustrate an embodiment of an engine having various return passages to facilitate the flow of lubricating oil and blow-by gas to parts of the engine and to reduce, mitigate, and/or eliminate interference between flowing lubricating oil and blow-by gas. The embodiments disclosed herein are described in the context of an outboard motor because these embodiments have particular utility in this context. However, the embodiments and inventions herein can also be applied to various engines for land, air, and marine vehicles alike. It is to be understood that the embodiments disclosed herein are exemplary but non-limiting embodiments, and thus, the inventions disclosed herein are not limited to the disclosed exemplary embodiments.

With reference now to FIGS. 1-4, a first embodiment of an engine 11 is illustrated. As will be described in greater detail below, the engine 11 can provide for a generally smooth flow of lubricating oil back to an oil pan from various parts of the engine 11 in order to ensure that the engine output is relatively improved. In particular, some embodiments allow for the efficient return of lubricating oil from the crank chamber in order to reduce the likelihood of unnecessary rotation of large amounts lubricating oil with the crankshaft so that the engine output is less likely to be negatively affected.

Figure 2:
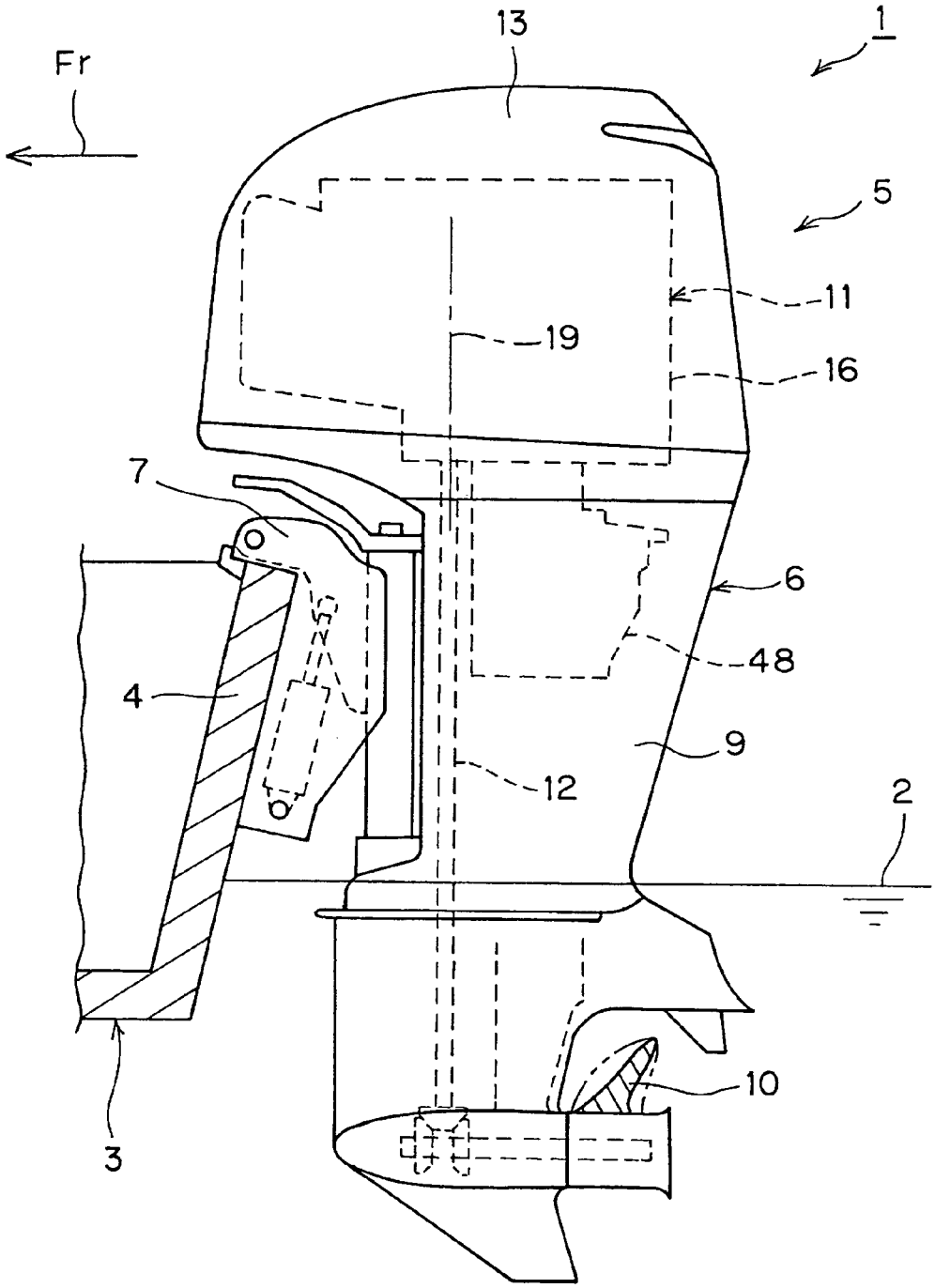
FIG. 2 is a side view of the outboard motor having the engine illustrated in FIG. 1 in hidden lines.

As shown in the embodiment of FIG. 2, the engine 11 can be utilized with a watercraft 1 floating on the surface of water 2. The arrow Fr indicates the front of the engine 11 in the direction of propulsion of the watercraft 1. The watercraft 1 is provided with a hull 3 and an outboard motor 5 supported on the stern 4 of the hull 3. The outboard motor 5 can be disposed in the rear of the hull 3 and can be provided with an outboard motor body 6 for producing propulsion force to enable propulsion of the hull 3. Further, the outboard motor 5 can include a bracket 7 for supporting the outboard motor body 6 detachably to the stern 4.

The outboard motor body 6 can include a case 9 extending generally in the vertical direction. An upper part of the case 9 can be supported on the stern 4 by the bracket 7 and a lower part of the case 9 can be submerged into the water 2. The outboard motor 5 can comprise a propeller 10, the engine 11, a power transmission mechanism 12, and a cowling 13. The propeller 10 can be supported at the lower end of the case 9. The engine 11 can be supported at the upper end of the case 9. The power transmission mechanism 12 can be housed in the case 9 for connecting the propeller 10 to the engine 11 for associated movement. Finally, the cowling 13 can be configured for covering the engine 11 and can be configured to be opened from the outside.

Figure 1:
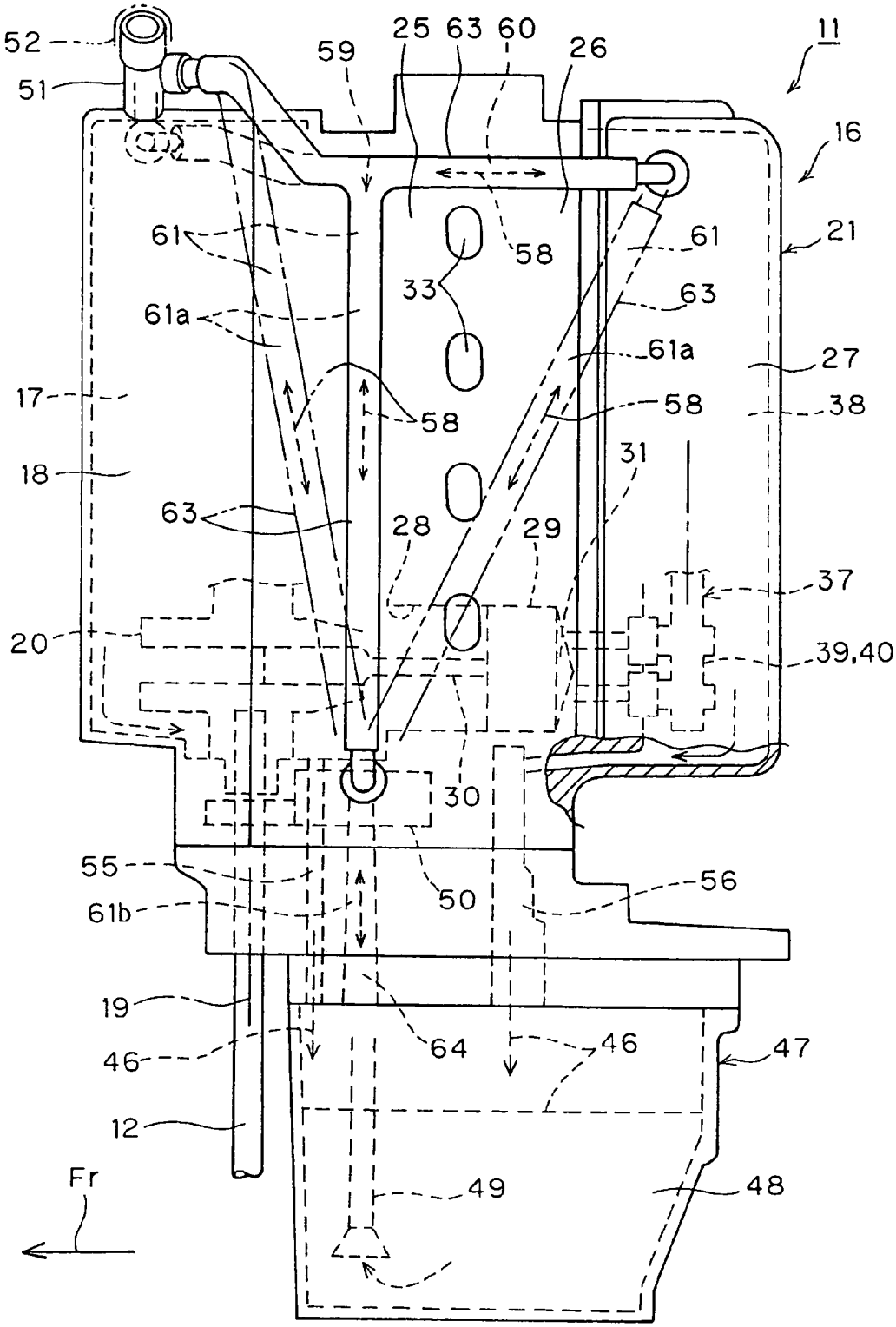
FIG. 1 is a side view of an engine for an outboard motor according to an embodiment.
Figure 3:
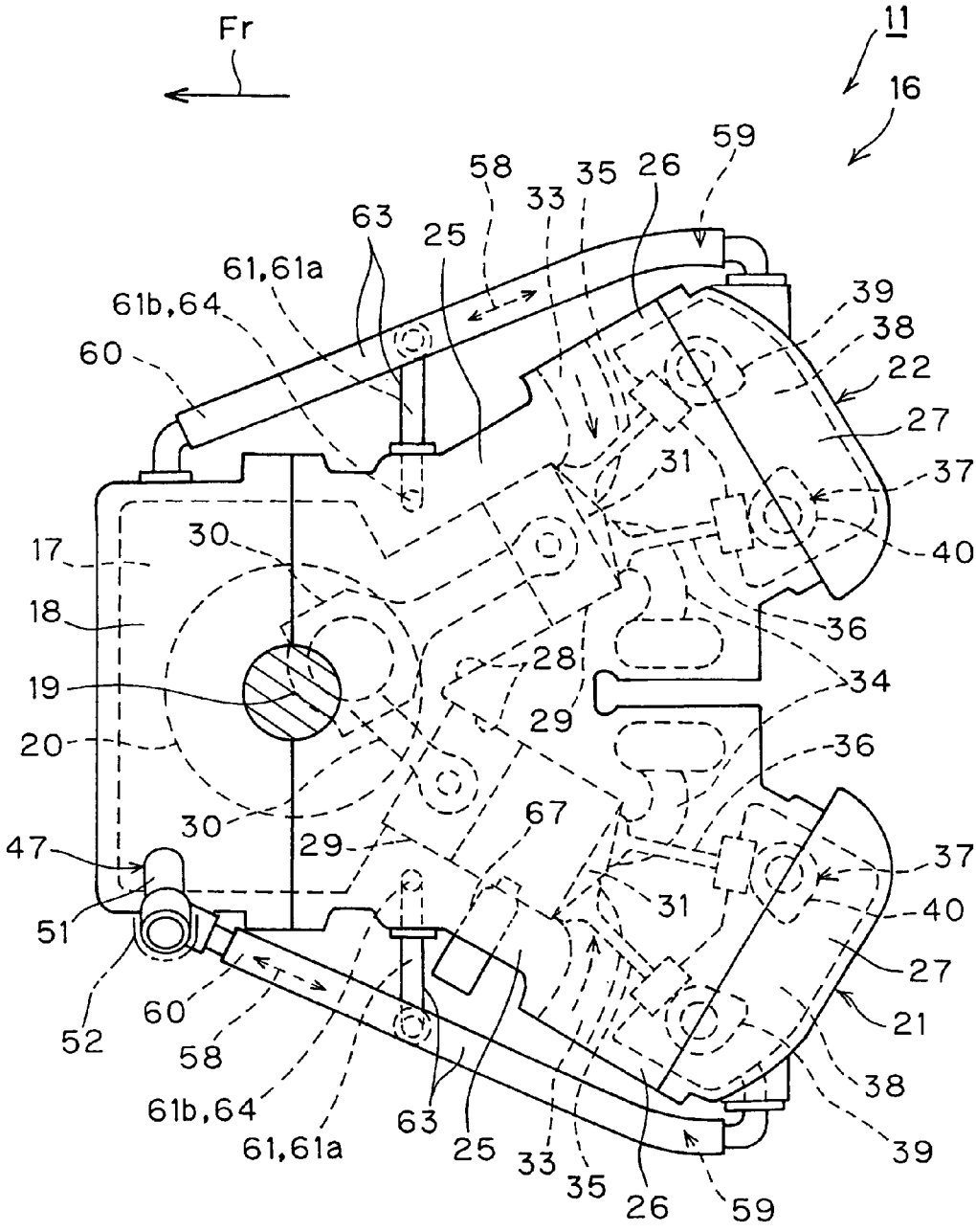
FIG. 3 is a plan view of the engine illustrated in FIG. 1.

As shown in FIGS. 1-3, the engine 11 can be a four-stroke, V-type multiple-cylinder internal combustion engine and can be provided with an engine body 16 supported on the case 9 at the upper side. However, various other engine types and sizes can be utilized in accordance with various embodiments disclosed herein. The engine body 16 can be supported on the case 9 at the upper side. Further, the engine body 16 can include a crankcase 18, a crankshaft 20, and left and right banks 21 and 22. The crankcase 18 can be configured such that an inside portion thereof constitutes a crank chamber 17. The crankshaft 20 can be supported on the crankcase 18 so as to be rotatable around a crankshaft axis 19. The crankshaft axis 19 can extend generally in the horizontal direction; however, as illustrated in FIGS. 1-4, the crankshaft axis 19 preferably extends generally in the vertical direction. The left and right banks 21 and 22 can be formed to project from the crankshaft 20 generally toward the rear of the engine 11 in the shape of a letter V in plan view (FIG. 3). However, depending on the selected engine configuration, the left and right banks 21 and 22 can also be configured to extend in other directions as well.

Each bank 21, 22 can include a cylinder block 25, a cylinder head 26, a cylinder head cover 27, pistons 29, and connecting rods 30. In some embodiments, the cylinder block 25 can project rearward from the crankcase 18. The cylinder head 26 can be mounted to the projecting end of the cylinder block 25. The cylinder head cover 27 can be mounted to the cylinder head 26 at the outer side. The pistons 29 can be inserted into a plurality (e.g., four) of cylinder holes 28 in the cylinder block 25 so as to be slidable in the axial direction. Finally, the connecting rods 30 can be configured to cooperatively interconnect the crankshaft 20 and pistons 29 for associated movement with each other. The space in each cylinder hole 28 surrounded by the cylinder head 26 and piston 29 near the top dead center can constitute a combustion chamber 31.

The cylinder head 26 can be configured to include intake and exhaust ports 33, 34 that can allow communication of the combustion chamber 31 with the outside of the cylinder head 26. Further, the engine 11 can also include intake and exhaust valves 35, 36 that can be provided to enable the opening and/or closing of the intake and exhaust ports 33, 34. The intake port 33 can constitute part of the intake system of the engine 11. In addition, a valve drive device 37 can be provided for actuating the intake and exhaust valves 35, 36. In some embodiments, the valve drive device 37 can be configured to open and close the intake and exhaust valves 35, 36 in association with movement of the crankshaft 20.

As shown in FIG. 3, the valve drive device 37 can be provided with intake and exhaust cam shafts 39, 40. The intake and exhaust cam shafts 39, 40 can be disposed in a cam chamber 38, which can be formed between the cylinder head 26 and the cylinder head cover 27. The intake and exhaust cam shafts 39, 40 can be supported on the cylinder head 26 so as to be rotatable around their axes generally parallel to the axis 19 of the crankshaft 20. Further, the intake and exhaust cam shafts 39, 40 can be cam-engaged with the intake and exhaust valves 35, 36. Thus, the intake and exhaust camshafts 39, 40 can be utilized to actuate the intake and exhaust valves 35, 36 for the valve opening and valve closing, as appropriate, in association with the movement of the crankshaft 20.

The engine 11 can also include a lubrication device 47 for lubricating portions to be lubricated in the engine 11. Such portions to be lubricated can include, for example, the crankshaft 20, bearing sections of the cam shafts 39, 40, cam engagement portions of the intake and exhaust valves 35, 36 with the cam shafts 39, 40, and other various portions of the engine 11. The lubrication device 47 can be housed in the case 9 at the upper part thereof. The lubrication device 47 can include an oil pan 48, an oil pump 50, an oil inlet 51, and a cap 52. In some embodiments, the oil pan 48 can be located below the engine body 16 for storing lubricating oil 46; however, the oil pan 48 can also be located remotely from the engine 11. The oil pump 50 can be connected for associated operation to the power transmission mechanism 12. For example, in accordance with an embodiment, the oil pump 50 can be adapted to suck lubricating oil 46 from the oil pan 48 through a suction pipe 49 while delivering the lubricating oil 46 to the portions to be lubricated. The oil inlet 51 can be mounted to the crankcase 18 at the upper end, and the cap 52 can be configured to facilitate the opening and closing of the oil inlet 51. Further, it is contemplated that various modifications and alterations can be made to the embodiments disclosed herein.

Referring again to FIG. 1, the engine 11 also can be configured to include a crank chamber oil-return passage 55. The oil-return passage 55 can allow natural inflow of lubricating oil 46 from the crank chamber 17 of the engine 11 after the lubricating oil 46 has circulated about the portions to be lubricated within the crank chamber 17. Thus, in some embodiments, the lubricating oil 46 can be returned from the crank chamber 17, such as from the inner bottom of the crank chamber 17, to the oil pan 48. Further, the crank chamber oil-return passage 55 can be formed in the crankcase 18 of the engine body 16.

As also shown in FIG. 1, the engine can also be configured to include a cam chamber oil-return passage 56. The cam chamber oil-return passage 56 can allow natural inflow of lubricating oil 46 from the cam chamber 38 after the lubricating oil 46 has circulated about the portions to be lubricated within the cam chamber 38. Thus, in some embodiments, the lubrication oil 46 can be returned from the cam chamber 38, such as from the inner bottom of the cam chamber 38, to the oil pan 48. Further, the cam chamber oil-return passage 55 can be formed in each bank 21, 22 of the engine body 16.

In addition to the crank chamber oil-return passage 55 and cam chamber oil-return passages 56, the engine 11 can also be configured to include a gas passage 59. The gas passage 59 can be sized and configured to allow blow-by gas 58 to be communicated between the crank chamber 17, the cam chamber 38, and the interior of the oil pan 48. In an exemplary embodiment illustrated in FIGS. 1 and 3, the gas passage 59 can be formed by a first gas passage 60 connected at its ends to the upper part of the crank chamber 17 and the upper part of the cam chamber 38, thus allowing communication of the crank chamber 17 and the cam chamber 38 with each other. Further, as shown in FIG. 3, a second gas passage 61 can also be provided that can allow communication of the longitudinally halfway portion of the first gas passage 60 with the interior of the oil pan 48. In such an embodiment, the section in the first gas passage 60 from its end to the halfway portion can also serve as a section of the second gas passage 61 running toward the crank chamber 17 or the cam chamber 38.

In accordance with another embodiment, another gas passage can be formed in order to allow communication between the cam chamber 38 and the intake system of the engine 11 or between the cam chamber 38 and the intake port 33 side. In some embodiments, after being sucked in the intake system through the other gas passage, blow-by gas 58 in the cam chamber 38 can then be subjected to a burning process, together with a mixture in the combustion chamber 31, and subsequently be discharged to the outside of the engine 11.

The gas passage 59 can be formed, at least in part, by a metallic pipe material 63 provided outside the engine body 16. In some embodiments, the first gas passage 60 can be formed utilizing pipe material 63. Additionally, one section 61*a* of the second gas passage 61 can be formed utilizing the pipe material 63, and the other section 61*b* can be formed to correspond to a passage hole 64. The passage hole 64 can be formed in the crankcase 18 of the engine body 16. The pipe material 63 can be made of various types of materials, such as a plastic pipe or a rubber hose. In addition, portions or the entire system can be formed with pipe or can be formed as passages, depending upon the application.

In some embodiments, at least one of the first gas passage 60 and the second gas passage 61 of the gas passage 59 can be provided for the banks 21 and 22 of the engine 11. In this regard, the engine 11 can be configured to include one of left and right gas passages 59 that can connect to one of the banks 21, 22. Additionally, the left and right passages 59 can each independently connect to a respective bank 21, 22 to allow independent flow of blow-by gas 58 to each of the respective banks 21, 22. In such an embodiment, as illustrated in FIG. 3, the gas passages 59 can provided on the engine 11 at the left and right outer sides thereof. For example, the first gas passage 60 of the left gas passage 59 can be connected at the forward end to the oil inlet 51 and can be in communication with the crank chamber 17 through the oil inlet 51.

As shown in FIG. 1 by hidden lines, the crank chamber 17 and the cam chamber 38 can be in direct communication with each other. In addition to or in place of this arrangement, the cam chamber 38 and the interior of the oil pan 48 can be in direct communication with each other.

The watercraft 1 can be propelled when the propeller 10 is rotated through the power transmission mechanism 12, which can occur as a result of operation of the engine 11. During operation of the engine 11, lubricating oil 46 in the oil pan 48 can be supplied to the portions to be lubricated by the oil pump 50. During lubrication, lubricating oil 46 can collect in the crank chamber 17 and cam chamber 38 and can tend to stay there. In various embodiments, this lubricating oil 46 can be returned to the interior of the oil pan 48 through the crank chamber oil-return passage 55 and the cam chamber oil-return passage 56.

Furthermore, in association with operation of the engine 11, blow-by gas 58 can move from the combustion chamber 31 into the crank chamber 17 and can be forced, by virtue of its air pressure, to flow into the cam chamber 38 and the oil pan 48 through the gas passage 59. At least some of the blow-by gas 58 forced to flow into the cam chamber 38, after being sucked in the intake system of the engine 11, can be subjected to combustion. Further, the blow-by gas 58 forced into the oil pan 48 can thereafter be forced to flow into the cam chamber 38 through the gas passage 59 and can also be subjected to combustion. Furthermore, depending on the operating conditions of the engine 11, the blow-by gas 58 can move through the gas passage 59 when the blow-by gas 58 in the oil pan 48 begins to move toward the crank chamber 17.

The blow-by gas 58 can thus move through the gas passage 59 as it moves between the crank chamber 17, the cam chamber 38 and the interior of the oil pan 48. Further, as mentioned above, the lubricating oil 46 can flow from the crank chamber 17 and the cam chamber 38 into the oil pan 48 through the respective ones of the crank chamber oil-return passage 55 and the cam chamber oil-return passage 56. Therefore, according to such an embodiment, the blow-by gas 58 will not substantially interfere with the lubricating oil 46 when the lubricating oil 46 flows into the oil pan 48. Thus, the blow-by gas 58 can flow smoothly in the engine 11 without interference, and the lubricating oil 46 in the crank chamber 17 and the cam chamber 38 can flow smoothly into the oil pan 48 without substantial interference from the blow-by gas 58.

As a result, the lubricating oil 46 is less likely to collect in the crank chamber 17 in a large quantity. Thus, any additional drag on the rotation of the crankshaft 20 due to excess lubricating oil 46 can be mitigated so that a desired engine output can be obtained.

Further, as described above, the ends of the gas passage 59 connect to the upper parts of the crank chamber 17 and the cam chamber 38, respectively. Nevertheless, it is contemplated that other embodiments can be formed wherein the ends of the gas passages 59 can be connected to the mid-portions of the crank chamber 17 and the cam chambers 38 in the vertical direction.

Therefore, lubricating oil 46 in the crank chamber 17 and cam chamber 38 can be more apt to stay in the inner bottom of each of the crank chamber 17 and the cam chamber 38, while blow-by gas 58 tending to flow into the gas passage 59 from the crank chamber 17 and the cam chamber 38 can move in the upper portion of the crank chamber 17 and the cam chamber 38. As a result, interference between the lubricating oil 46 and the blow-by gas 58 can be suppressed more reliably, and lubricating oil 46 in the crank chamber 17 and the cam chamber 38 can flow into the oil pan 48 more reliably and smoothly.

Further, as described above, the gas passage 59 can be formed by a first gas passage 60 allowing communication of the crank chamber 17 with the cam chamber 38 and a second gas passage 61 allowing communication of one of the crank chamber 17 and the cam chamber 38 with the interior of the oil pan 48.

The total length of the gas passage 59 can vary. For example, the total length can be longer if, in addition to formation of the first gas passage 60, additional gas passages are formed in order to allow communication of the crank chamber 17 and cam chamber 38 with the interior of the oil pan 48, respectively. Various modifications and configurations can be made. However, according to several embodiments, reduced interference between the blow-by gas 58 and the lubricating oil 46, resulting in a desirable engine output, can be obtained with a simple structure.

Further, as described above, some embodiments allow the midway portion of the first gas passage 60 to be in communication with the interior of the oil pan 48 by the second gas passage 61.

Therefore, in some embodiments, connections for connecting the ends of the second gas passage 61 to the crank chamber 17 and cam chamber 38 can be dispensed with. As a result, the foregoing desired engine output can be obtained with a simple structure.

Further, as described above, the engine 11 can be a V-type engine and the gas passage 59 can be provided for each bank 21 or 22 of the engine 11 independently.

In a case where the watercraft 1 changes its posture or acceleration during its propulsion by the operation of the engine 11, the oil surface of the lubricating oil 46 in the oil pan 48 can tilt or wave, which might cause the possibility of closing the opening of the gas passage 59 to the interior of the oil pan 48 by the lubricating oil 46. In order to prevent such an occurrence, some embodiments provide that individual gas passages 59 can be provided for each bank 21, 22; further, other embodiments also allow that a plurality of openings of the gas passages 59 to the interior of the oil pan 48 can be formed. Therefore, simultaneous closing of these openings by the lubricating oil 46 can be avoided and blow-by gas 58 can be moved through one or more gas passages 59. As a result, the likelihood of interference between the blow-by gas 58 and the movement of the lubricating oil 46 can be reduced as the lubricating oil 46 moves in the crank chamber oil-return passage 55 and cam chamber oil-return passage 56.

Further, in accordance with some embodiments, at least one section of the gas passage 59 can be formed by a pipe material 63. In other embodiments, the gas passage 59 can be provided outside the engine body 16.

In some embodiments, the engine body 16 can be formed with complicated oil passages of the lubrication device 47 and cooling water passages. Therefore, as described above, in embodiments where the pipe material 63 is used for the gas passage 59, the gas passage 59 need not be integrally formed into the engine body 16. Thus, such embodiments tend to ensure that the structure of the engine 11 is less likely to become more complicated due to the gas passage 59. As a result, the foregoing desired engine output can be obtained with a relatively simple structure.

Further, the pipe material 63 can be provided on outside of or on an outer side of the engine body 16 so that piping work can be performed easily. In such an embodiment, the pipe material 63 and its connection to the engine 11 can be designed configured to allow easy access when connecting the pipe material 63 to the engine body 16 or performing maintenance. Nevertheless, it is also contemplated that the whole of the gas passage 59 can be advantageously formed inside the engine body 16 or within one or more walls of the engine 11.

Figure 4:
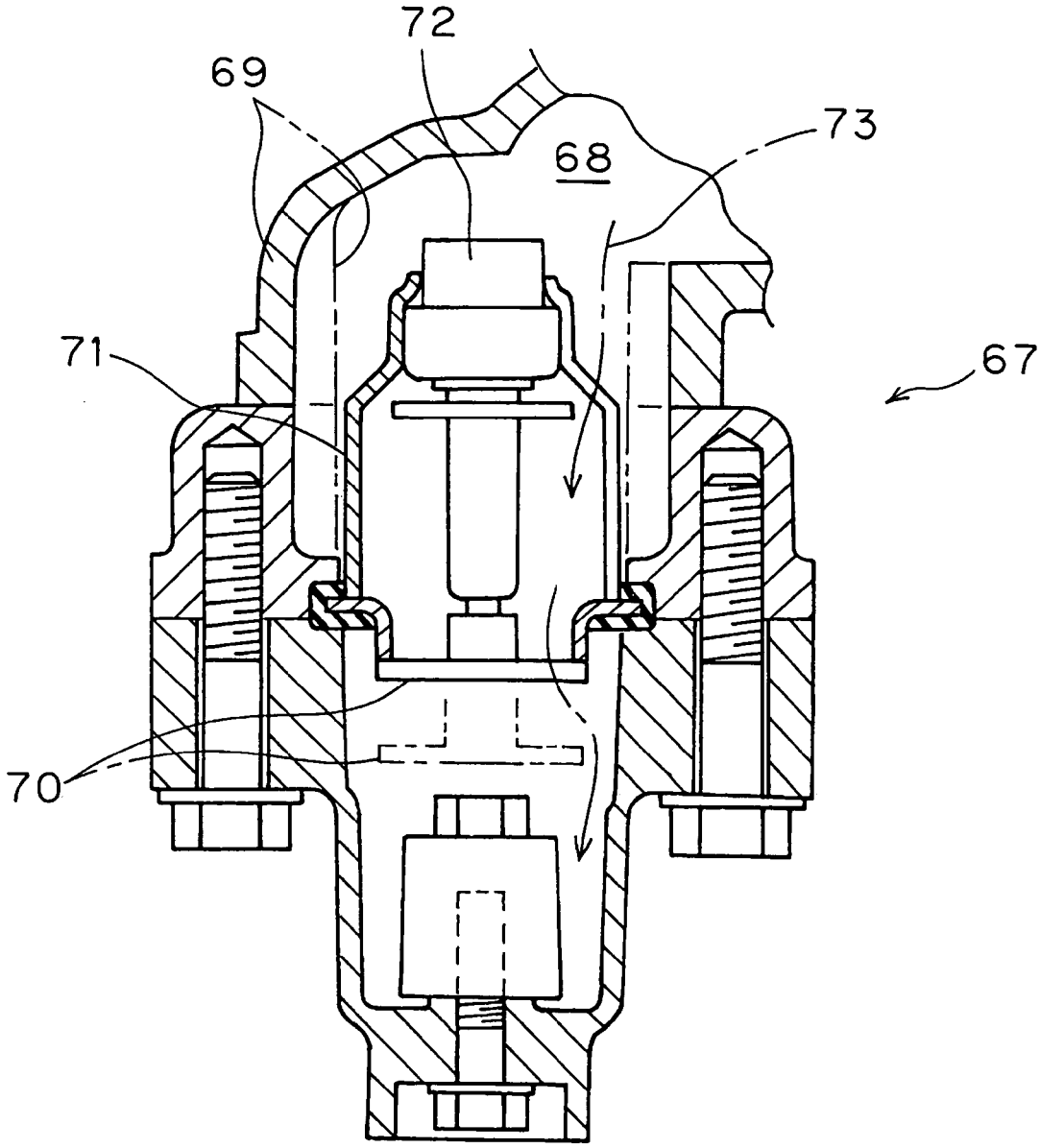
FIG. 4 is a sectional view of a thermostat.

In the embodiment shown in FIGS. 3 and 4, a thermostat 67 can be provided in a part of a cooling water passage formed in the engine body 16. The thermostat 67 can include a housing 69 mounted to the engine body 16 and can have a cooling water passage 68 formed inside, a valve body 70, and a cylinder 72. The valve body 70 can be configured to allow for the opening and closing of the cooling water passage 68. The cylinder 72 can be supported on the housing 69 by a retainer 71 while supporting the valve body 70 and having wax therein.

When the temperature of cooling water 73 passing through the cooling water passage 68 is high, the wax inside the cylinder 72 can expand and cause the cylinder 72 to extend the valve body 70. This movement further causes the valve body 70 to open the cooling water passage 68 (shown in FIG. 4 by the single dot and dash lines). On the other hand, when the temperature of the cooling water 73 becomes lower, the wax can contract and cause the cylinder 72 to contract its length, and, in association with this movement, cause the valve body 70 to close the cooling water passage 68 (shown in FIG. 4 by the solid lines).

The housing 69 can be made of aluminum alloy and the retainer 71 can be made of stainless steel. Thus, in some embodiments, the housing 69 and the retainer 71 can be are made of materials different from each other.

In accordance with some embodiments, the inside surface of the housing 69 and the retainer 71 can be configured to substantially reduce, avoid, and/or eliminate electrolyte corrosion that can occur if sea water stays stagnant between the housing 69 and the retainer 71. For example, the double dot and dashed lines of FIG. 4 illustrate where an inside surface of the housing was located in prior art thermostats. Because the inside surface of the housing was so close to the retainer of the cylinder and there was little space between the housing and the retainer, a local battery or pocket would be formed by sea water staying between the housing and the retainer. This stagnant pocket could result in electrolytic corrosion. (This explanation and illustration using superimposed double dot and dashed lines over FIG. 4 is provided to illustrate the spacing of such components in the prior art, and does not signify that the solid-lined illustrated embodiment of FIG. 4 is prior art.) In contrast, some embodiments herein provide that an inside surface of the housing 69 and the retainer 71 can be separated from each other to a large extent (as shown in the solid lines labeled 69). Thus, as illustrated, the spacing between the housing 69 and the retainer 71 can tend to promote movement of the water and the likelihood of the foregoing electrolytic corrosion can be reduced.

Figure 5:
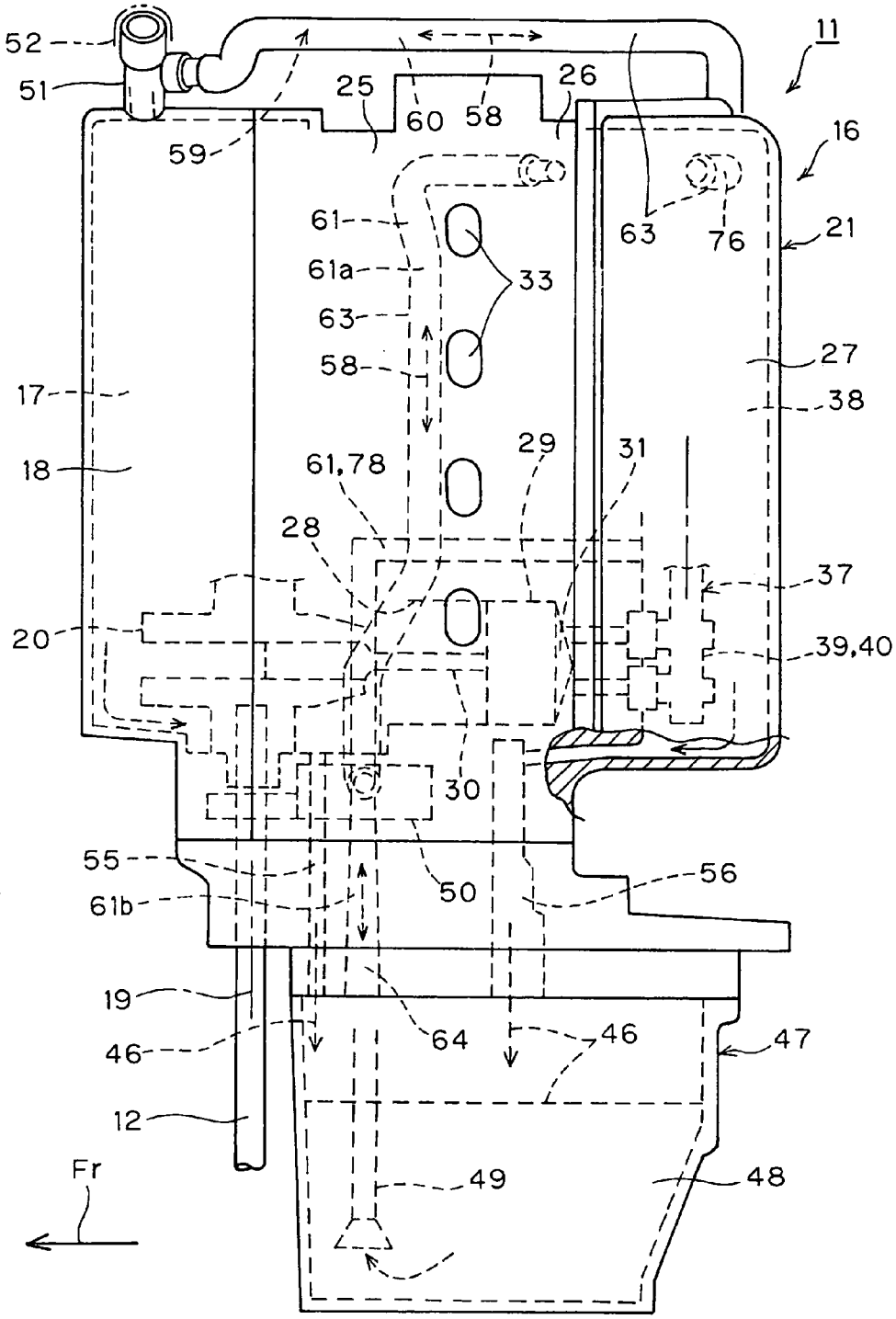
FIG. 5 is a side view of another engine in accordance with another embodiment.
Figure 6:
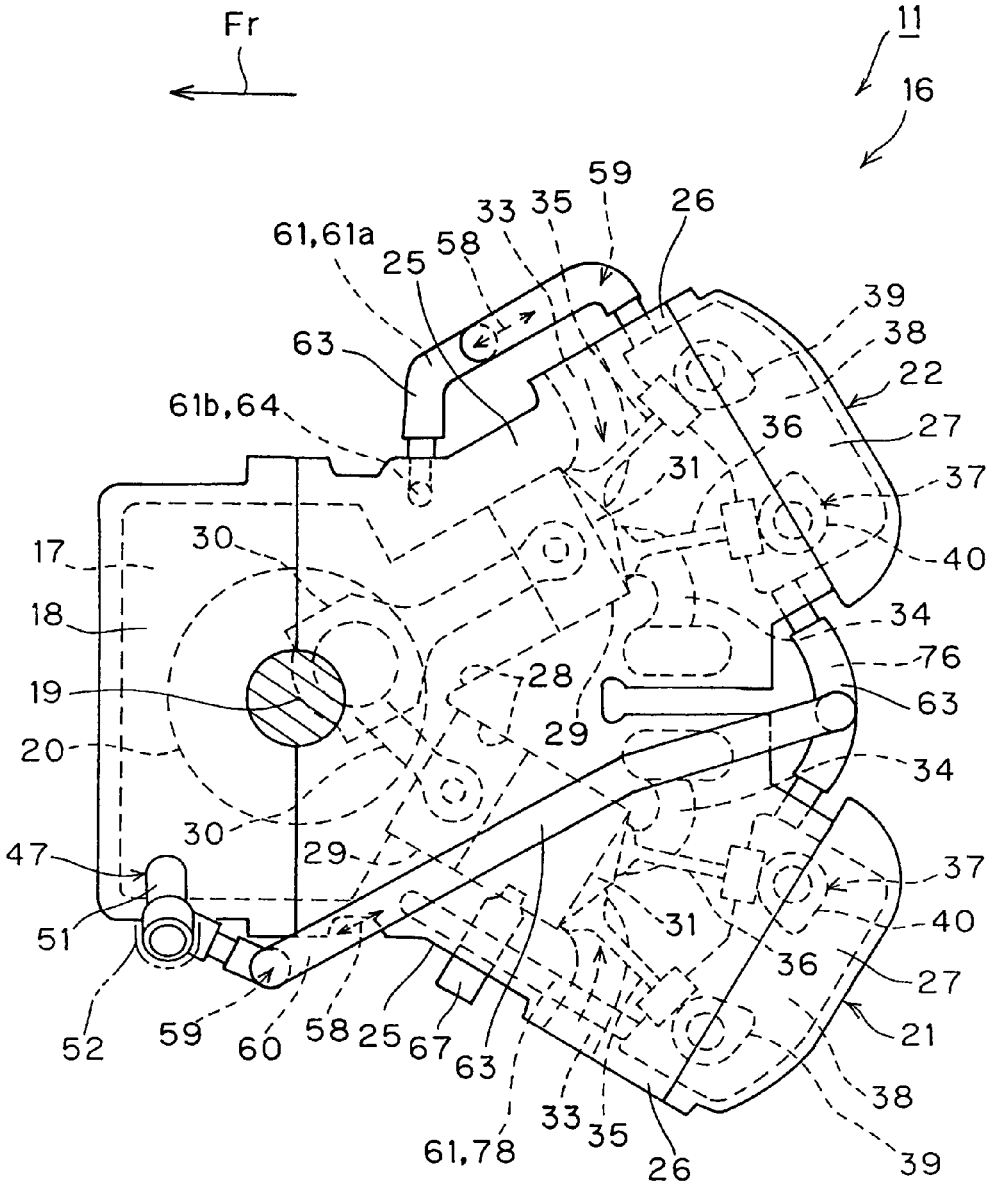
FIG. 6 is a plan view of the engine illustrated in FIG. 5.

Yet another embodiment is illustrated in FIGS. 5 and 6. Such an embodiment can be configured to include many of the features noted above and can be similar in its arrangement, effect and function. As such, common parts are designated by common reference numerals in FIGS. 5 and 6, and repeated description is omitted, so that different points will be mainly described. In addition, constructions of parts in these embodiments may be combined in various ways.

In accordance with the embodiment illustrated in FIGS. 5 and 6, part of the gas passage 59 can be formed by a third gas passage 76. The third gas passage 76 can allow communication of cam chambers 37 in the left and right banks 21, 22 with each other. The third gas passage 76 can be formed by a pipe material 63 and can be disposed between the left and right banks 21, 22.

The first gas passage 60 can be configured such that the upper part of the crankcase 18 and the midway portion of the third gas passage 76 are in communication with each other. The first gas passage 60 can also be configured such that it allows communication between the crankcase 18 and the cam chamber 38 of one of the left and right banks 21, 22.

The second gas passage 61 can be configured to allow communication between the cam chamber 38 of one of the left and right banks 21, 22 and the interior of the oil pan 48. The second gas passage 61 can be formed by another passage hole 78 formed in the engine body 16. The cam chamber 38 in the other bank 22 and the interior of the oil pan 48 can communicate through the second gas passage 61 formed by the pipe material 63.

In some embodiments, the engine 11 can be a V-type engine and part of the gas passage 59 can be formed by a third gas passage 76 allowing communication of cam chambers 38 in the banks 21, 22 of the engine 11 with each other.

Therefore, even if communication between the crank chamber 17 and the cam chambers 38 in the banks 21, 22 is not allowed by the respective first gas passages 60, the crank chamber 17 and the cam chambers 38 in the banks 21, 22 can be in communication with each other by the single first gas passage 60 and the third gas passage 76.

In some embodiments, the cam chambers 38 in the banks 21, 22 of the V-type engine 11 can be disposed close to each other. Therefore, the third gas passage 76 can allow communication between the cam chambers 38 in the banks 21, 22, and can be shorter than the first gas passage 60. As a result, with formation of the third gas passage 76, the gas passage 59 can be shortened compared to embodiments wherein the crank chamber 17 and the cam chambers 38 in the banks 21, 22 are allowed to be in communication by the respective first gas passages 60. Thus, a desired engine output can be obtained with a relatively simple structure.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An engine for an outboard motor, the engine comprising: a crank chamber; a cam chamber; a crankshaft having an axis extending substantially in the vertical direction: an oil pan defining an oil reservoir being disposed below and separated from the crank chamber; a crank chamber oil-return passage being in fluid communication with the crank chamber and the oil pan, the crank chamber oil-return passage being sized and configured to allow lubricating oil to be returned from the crank chamber to the oil pan; a cam chamber oil-return passage being in fluid communication with the cam chamber and the oil pan, the cam chamber oil-return passage being sized and configured to allow lubricating oil to be returned from the cam chamber to the oil pan; and a gas passage being in fluid communication with the crank chamber, the cam chamber, and the oil pan, the gas passage being sized and configured to allow passage of blow-by gas therethrough without interfering with the movement of the lubricating oil.

2. The engine of claim 1 wherein the gas passage comprises ends that are connected to the crank chamber and cam chamber.

3. The engine of claim 1 wherein the gas passage is formed by a first gas passage and a second gas passage, the first gas passage allowing communication between the crank chamber and the cam chamber, and the second gas passage allowing communication of at least one of the crank chamber and the cam chamber with the oil pan.

4. The engine of claim 3 wherein a mid-portion of the first gas passage is in communication with the oil pan via the second gas passage.

5. The engine of claim 3 wherein the engine is a V-type engine comprising a first cylinder bank and a second cylinder bank, the cam chamber being a first cam chamber associated with the first cylinder bank, a second cam chamber being associated with the second cylinder bank, part of the gas passage being formed by a third gas passage allowing communication between the first and second cam chambers.

6. The engine of claim 1 wherein the engine is a V-type engine comprising a first cylinder bank and a second cylinder bank, the gas passage being provided for each of the first and second cylinder banks of the engine independently.

7. The engine of claim 1 wherein at least one section of the gas passage is formed by a pipe material provided on an outside of the engine.

8. The engine of claim 1 wherein the crankshaft has an axis that extends substantially vertically.

9. The engine of claim 1 wherein the crank chamber and the oil pan are separated by a wall of a crankcase.

10. An engine for an outboard motor, the engine comprising:

a crankcase being sized and configured to support a crankshaft, the crankshaft having an axis extending substantially in the vertical direction, the crankcase defining a crank chamber;

an oil pan disposed generally below the crankcase;

a crank chamber oil-return passage being in fluid communication with the crank chamber and the oil pan, the crank chamber oil-return passage being sized and configured to allow lubricating oil to be returned from the crank chamber to the oil pan; and a gas passage being in fluid communication with the oil pan and the crank chamber, the gas passage being sized and configured to allow passage of blow-by gas therethrough to reduce interference of blow-by gas with lubricating oil from the crankcase to facilitate return of lubricating oil from the crankcase to the oil pan.

11. The engine of claim 10 further comprising a cam chamber, a cam chamber oil-return passage being in fluid communication with the cam chamber and the oil pan, the cam chamber oil-return passage being sized and configured to allow lubricating oil to be returned from the cam chamber to the oil pan.

12. The engine of claim 11 wherein the gas passage is in direct fluid communication with the crank chamber, the cam chamber, and the oil pan, the gas passage being sized and configured to allow passage of blow-by gas therethrough without causing substantial interference with movement of lubricating oil.

13. The engine of claim 12 wherein openings of the gas passage are connected to the crank chamber and cam chamber.

14. The engine of claim 12 wherein the gas passage comprises a first gas passage and a second gas passage, the first gas passage allowing communication between the crank chamber and the cam chamber, the second gas passage allowing communication of at least one of the crank chamber and the cam chamber with the oil pan.

15. The engine of claim 14 wherein a mid-portion of the first gas passage is in communication with the oil pan via the second gas passage.

16. The engine of claim 14 wherein the engine comprises a first cylinder bank and a second cylinder bank, part of the gas passage being formed by a third gas passage allowing communication of cam chambers in the cylinder banks of the engine with each other.

17. The engine of claim 12 wherein the engine comprises a first cylinder bank and a second cylinder bank, the gas passage being provided independently for each of the first and second cylinder banks.

18. The engine of claim 12 wherein at least one section of the gas passage is formed by a pipe material provided outside of the engine.

19. An engine for an outboard motor, the engine comprising:

a crankcase being sized and configured to support a crankshaft, the crankshaft having an axis extending substantially vertically, the crankcase defining a crank chamber;

an oil pan disposed generally below the crankcase;

a cam chamber; and means for fluidically communicating the crank chamber, the oil pan, and the cam chamber and for allowing passage of blow-by gas therethrough to reduce interference of blow-by gas with lubricating oil from the crankcase and cam chamber to facilitate return of lubricating oil from the crankcase and the cam chamber to the oil pan.

20. The engine of claim 19 wherein the gas passage is in direct fluid communication with the crank chamber, the cam chamber, and the oil pan.

21. The engine of claim 19 wherein at least one section of the gas passage is formed by a pipe material provided outside of the engine.

22. The engine of claim 19 wherein the gas passage comprises first and second gas passages, the first gas passage extending intermediate the crank chamber and the cam chamber to allow communication between the crank chamber and the cam chamber, the second gas passage extending between the oil pan and at least one of the crank chamber and the cam chamber to allow communication between the oil pan and at least one of the crank chamber and the cam chamber.

23. The engine of claim 19 wherein the gas passage comprises first and second gas passages, the first gas passage extending intermediate the crank chamber and the cam chamber to allow communication between the crank chamber and the cam chamber, the second gas passage extending between the oil pan and the first gas passage to allow communication between the oil pan, the crank chamber, and the cam chamber.

* * * * *

UNITED STATES PATENT AND TRADEMARK OFFICE

CERTIFICATE OF CORRECTION

PATENT NO. : 7,503,318 B2
APPLICATION NO. : 11/616796
DATED : March 17, 2009
INVENTOR(S) : Takahashi et al.

It is certified that error appears in the above-identified patent and that said Letters Patent is hereby corrected as shown below:

At column 10, line 19-21, in Claim 1, please change "An engine for an outboard motor, the engine comprising: a crank chamber; a cam chamber; a crankshaft having an axis extending substantially in the vertical direction:" to -- An engine for an outboard motor, the engine comprising: a crank chamber; a crankshaft having an axis extending substantially in the vertical direction; a cam chamber; --.

Signed and Sealed this

Twenty-fifth Day of August, 2009

David J. Kappos

David J. Kappos
*Director of the United States Patent and Trademark Office*